United States Patent [19]

Katsu et al.

[11] Patent Number: 4,856,577

[45] Date of Patent: Aug. 15, 1989

[54] ROTARY REGENERATIVE HEAT EXCHANGING CERAMIC BODY

[75] Inventors: Masanori Katsu, Aichi; Mikio Makino, Toyokawa, both of Japan

[73] Assignee: NGK Insulators, Ltd., Nagoya, Japan

[21] Appl. No.: 180,789

[22] Filed: Apr. 12, 1988

[30] Foreign Application Priority Data

Apr. 17, 1987 [JP] Japan ..... 62-95688

[51] Int. Cl.[4] ..... F28D 19/04

[52] U.S. Cl. ..... 165/8; 165/10; 65/33; 156/60; 156/304.1; 428/116; 428/118; 428/188

[58] Field of Search ..... 165/8, 10; 65/33; 156/60, 304.1; 428/116, 118, 188

[56] References Cited

U.S. PATENT DOCUMENTS 4,357,987 11/1982 Oda et al. ..... 165/10

4,381,815 5/1983 Frost et al. ..... 165/10

*Primary Examiner*—Albert W. Davis, Jr.

*Attorney, Agent, or Firm*—Arnold, White & Durkee

[57] ABSTRACT

A rotary regenerative heat exchanging ceramic body including a plurality of matrix segments. The matrix segments of ceramic honeycomb structures are joined by a bonding material into the rotary regenerative heat exchanging ceramic body in the form of a disk. Each the matrix segments includes cells whose shapes have anisotropy in Young's modulus in sectional planes perpendicular to through-apertures. The matrix segments are arranged so that directions in which the Young's moduli of the segments are smaller are substantially coincident with circumferential directions of the disk at least at four locations near an outer circumference of the disk.

6 Claims, 1 Drawing Sheet

ROTARY REGENERATIVE HEAT EXCHANGING CERAMIC BODY

BACKGROUND OF THE INVENTION

This invention relates to a rotary regenerative heat exchanging ceramic body for high temperature gases for use in gas turbine engines, Stirling engines and the like.

A rotary regenerative heat exchanging ceramic body of this type is in the form of a, honeycomb structure disk on the order of 20–200 in cm diameter and 2–20 cm in thickness having. Such a heat exchanging body is generally rotatably arranged to shut off two passages having semicircular cross-sections as obtained by dividing a circle into two parts.

A high temperature gas is caused to flow through one of the two passages during which the heat of the gas is absorbed in the heat exchanging ceramic body. The heat-exchanging body is then rotated so that it would give off heat to low temperature air which is counterflowing in the other passage. In this case, temperatures of the gas are for example 1000° C. at an entrance of the ceramic body and 200° C. at an exit thereof, while temperatures of the air are 100° C. at an entrance and 900° C. at an exit. As the exhaust gas and the air are counterflowing with each other, the entrance and the exit for the exhaust gas are closely adjacent the exit and entrance for the air, respectively, so that there are always temperature differences not less than 800° C. in the heat exchanging body to cause severe thermal stresses therein.

Moreover, as outer circumferences of the heat exchanging body are exposed to atmosphere a low temperature atmosphere, there are temperature differences between a center portion and the outer circumferences of the body to cause separate thermal stresses in addition to the above thermal stresses. Therefore, the rotary regenerative heat exchanging ceramic body needs to possess high heat-exchanging efficiency, and at the same time resist the considerable thermal stresses in use.

A small type heat exchanging ceramic body may be produced by extruding a ceramic material into a unitary body. With ceramic bodies of middle or large type, however, matrix segments made of a ceramic material should be jointed to each other by a bonding material such as cement, ceramic, glass or the like.

Such rotary regenerative heat exchanging ceramic bodies made of jointed segments have been typically disclosed in Japanese Patent Application Laid-open No. 55-46,338 belonging to the applicant or assignee of the present case. As disclosed in the Laid-open Application, it had been found that a ceramic body having a number of joined matrix segments with directions of their cells being in parallel is likely to cause cracks in the proximity of the outer circumferences due to considerable tensile stresses in circumferential directions during use. The considerable tensile stresses result from the thermal stresses above described. As well known, the ceramic body is poor in tensile strength in comparison with compressive strength so that the cracks are caused by the tensile stresses.

In order to avoid such a disadvantage of the ceramic body, it has been proposed to combine matrix segments having a plurality of different cell shapes. In U.S. Pat. No. 4,381,815. However, the ceramic body disclosed in the United States Patent is complicated in manufacturing processes and very expensive because of the matrix segments required to have a plurality of different cell shapes.

SUMMARY OF THE INVENTION

It is a primary object of the invention to provide a rotary regenerative heat exchanging ceramic body which eliminates all the disadvantages of the prior art and which prevents cracks occurring therein even when being subjected to thermal stresses without requiring matrix segments having a plurality of different cell shapes.

In order to achieve this object, in a rotary regenerative heat exchanging ceramic body made of a plurality of ceramic honeycomb structure matrix segments jointed in the form of a disk, according to the invention each of said matrix segments includes cells whose shapes have anisotropy in Young's modulus in sectional planes perpendicular to through-apertures, and said matrix segments are arranged so that directions in which the Young's moduli of the segments are smaller are substantially coincident with circumferential directions of said disk at least at four locations near to an outer circumference of the disk.

In a preferred embodiment of the invention, the shapes of the cells are rectangular or triangular.

The invention will be more fully understood by referring to the following detailed specification and claims taken in connection with the appended drawings.

DESCRIPTION OF THE PREFERRED EMBODIMENTS

Figure 1:
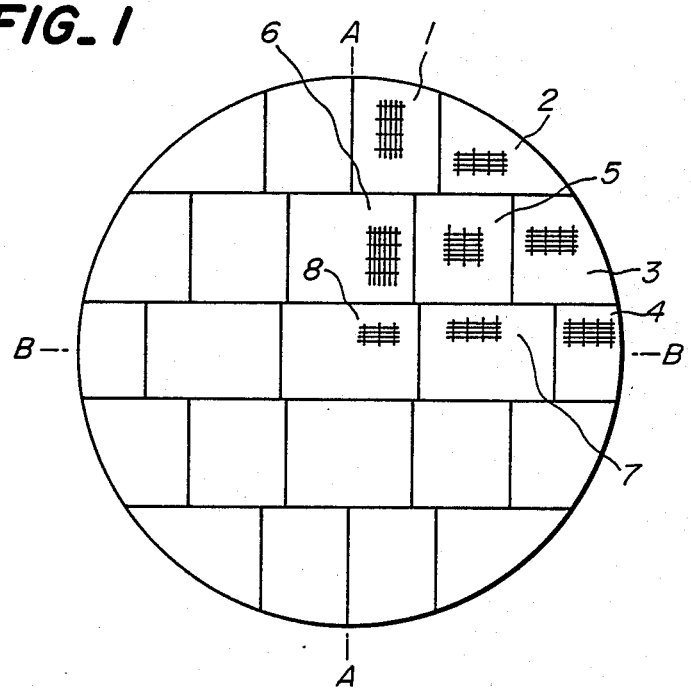
FIG. 1 is a plan view illustrating a first embodiment of the invention.

Ceramic matrix segments for constituting the rotary regenerative heat exchanging ceramic body according to the invention are particular in the shape of the cells and the arrangement of the segments.

Each of the ceramic material segments according to the first particular feature of the invention includes cells whose shape has an anisotropy in Young's modulus in sectional planes perpendicular to through-apertures having triangular or rectangular cross-sections. Such a shape of cells is advantageous for improving overall in efficiency which is a scale for estimating the heat exchanging efficiency of the rotary regenerative heat exchanging ceramic body. The overall fin efficiency is calculated by dividing a heat transfer coefficient by a coefficient of friction on wall surfaces and the efficiency is a function of Reynolds number. When using matrix segments whose cell shape is rectangular having a ratio of a short side to a long side of substantially 1:3½, particularly, the overall fin efficiency is remarkably improved in comparison with those having square cell shapes. Moreover, ceramic segments having triangular cell shapes are generally easy to increase the number of cells per unit area and exhibit improved overall fin efficiency in comparison with those having square cell shapes under the same manufacturing conditions.

With a honeycomb structure of cordierite whose cell shapes are rectangular having a ratio of a short side to a long side of 1:3½, it exhibits a significant anisotropy such that the Young's modulus in a short side direction is $4.45\times10^4$ kgf/cm$^2$ and $6.00\times10^4$ kgf/cm$^2$ in a long side direction. The latter is as much as 35% larger than the former.

According to the second particular feature of the invention, a plurality of the matrix segments having the anisotropy in Young's modulus are arranged and jointed such that directions in which the Young's moduli of the segments are smaller are substantially coincident with circumferential directions of a disk at least at four locations near to the outer circumference of the disk.

In general, thermal stresses due to temperature differences are caused by application of heat to one side of surfaces of a heat exchanging body. In this case, the strength of the body is greatly affected by so-called "thermal shock". Therefore, the thermal shock resistance of a ceramic body is important in case of rotary heat exchanging ceramic bodies. The thermal shock resistance is in inverse proportion to the Young's modulus as shown by the following equation. In order to improve the thermal shock-resistance, therefore, it is advantageous to arrange the matrix segments so that the direction in which the Young's moduli of the segments are smaller are substantially coincident with circumferential directions in which large tensile stresses occur in use. The thermal shock-resistance is usually studied by the following equation.

$$\Delta T_c = \sigma_f(1-\nu)/(E.\alpha)$$

where $\Delta T_c$: temperature difference before and after application of heat $\sigma_f$: strength $\nu$: Poissons ratio E : Young's modulus $\alpha$: coefficient of thermal expansion In the rotary regenerative heat exchanging ceramic body of this kind, particularly large tensile stresses would occur in circumferential directions at the outer circumference so that the directions of the matrix segments at the outer circumference are important, but the directions of the segments near to the center and between the center and the outer circumference are not greatly important. It is preferable to arrange the directions of segments in the above manner over all the circumference. However, such an arrangement of segments is difficult unless the matrix segments are in the form of sectors which are most preferable. Accordingly, as explained later in Example 1, the segments may be arranged in the above manner only at least at four locations near to the outer circumference.

Preferable examples according to the invention will be explained.

EXAMPLE 1

Matrix segments 1–8 made of cordierite as shown in FIG. 1 were used. The matrix segments were honeycomb structures including rectangular cells having the ratio of short sides to long sides of 1:3½. These matrix segments 1–8 were arranged in the form of a disk and jointed to a unitary body by a bonding material. As shown in FIG. 1, the matrix segments 1, 4, 6 and 7 were arranged in a manner that short sides of cells having smaller Young's moduli are substantially coincident with circumferential directions, but other matrix segments 2, 3, 5 and 8 were not arranged in the same manner. However, all the matrix segments were arranged in symmetry with respect to axes A—A and B—B. The rectangular cells had short sides of 0.56 mm and long sides of 0.96 mm. Thicknesses of walls were 0.11 mm. The rotary regenerative heat exchanging ceramic bodies had outer diameters of 453 mm and thicknesses of 83 mm.

These ceramic bodies were arranged in an electric furnace to apply thermal shocks thereto for testing the thermal shock resistance of the ceramic bodies. With ceramic bodies of jointed matrix segments of the prior art separately prepared, directions of all cells being in parallel as disclosed in the Japanese Patent Application Laid-open No. 55-46338, cracks occurred in the bodies when temperature differences were in excess of 800° C.. In contrast herewith, with the ceramic bodies according to the invention, cracks did not occur in the bodies until temperature differences were in excess of 875° C., whose thermal shock-resistance was improved 75° C. over that of the prior art.

When heat exchanging bodies are inserted into the electric furnace having heat sources at an upper portion or on both sides, one side of the bodies is rapidly heated in a manner similar to the thermal shock onto the bodies in actual use. Therefore, this test using an electric furnace is generally used for testing the thermal stresses in the heat-exchanging bodies.

The thermal stresses in the above test were analyzed with the aid of computers. As a result, it was found that the maximum tensile stresses were 30.0 kgf/cm$^2$ in the circumferential directions and 28.5 kgf/cm$^2$ in radial directions. These tensile stresses in both directions were under a preferable balanced condition. On the other hand, with the ceramic bodies of the prior art, the maximum tensile stresses were 41 kg/cm$^2$ in circumferential directions and 25 kg/cm$^2$ in radial directions.

EXAMPLE 2

Figure 2:
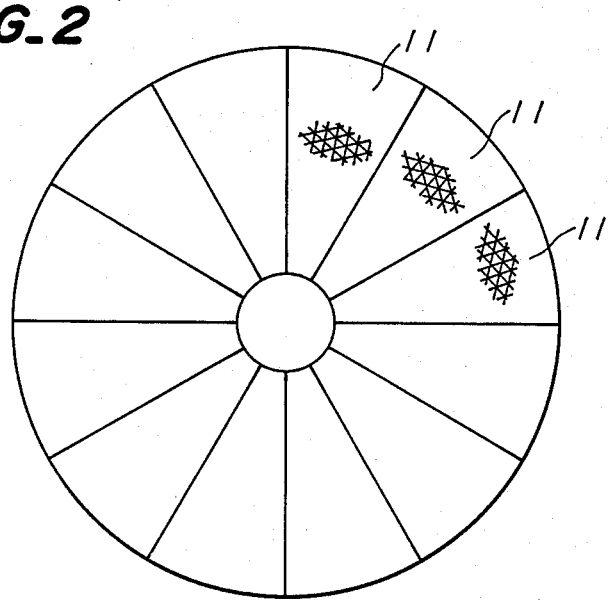
FIG. 2 is a plan view illustrating a second embodiment of the invention.

Matrix segments 11 made of cordierite as shown in FIG. 2 were used. The matrix segments were in the form of sectors including regular triangular cells. The twelve matrix segments 11 are arranged in the form of a disk and jointed into a unitary body by a bonding material. With these matrix segments 11, Young's moduli in radial directions were larger than those in circumferential directions. The regular triangular cells had sides of 1.27 mm. Thicknesses of walls were 0.13 mm. The ceramic segments had sizes of 155×100×75 mm which were worked to form rotary regenerative heat exchanging ceramic bodies. The ceramic bodies had outer diameters of 353 mm and thicknesses of 75 mm.

These ceramic bodies according to the invention were arranged in the electric furnace to apply thermal shocks thereto for testing the thermal shock resistance in the same manner as in Example 1. In this case, likewise, cracks did not occur in the ceramic bodies until temperature differences were in excess of 875° C.. The improvement of the thermal shock-resistance was ascertained.

Although the matrix segments having rectangular and triangular cells were used in the above Examples, matrix segments having cells of various shapes may of course be used such as flat rhombus, flat hexagon, elongated triangle, isosceles triangle and the like.

As can be seen from the above explanation, according to the invention, matrix segments including cells of shapes having the anisotropy in Young's modulus in sectional planes perpendicular to the through-apertures are arranged such that the directions in which Young's moduli are smaller are substantially coincident with circumferential directions. As a result, the thermal shock-resistance of the rotary regenerative heat exchanging ceramic body is remarkably improved, and the heat exchanging ceramic body is constituted by the matrix segments including cells having a single shape so that manufacturing cost is lowered. Therefore, the rotary regenerative heat exchanging ceramic body according to the invention eliminates the disadvantages of the prior art and greatly contributes to the development of the industry.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A rotary regenerative heat exchanging ceramic body, comprising a plurality of ceramic honeycomb structure matrix segments joined to form a disk, each of said segments comprising a plurality of intersecting partition walls defining a plurality of cells having anisotropic Young's moduli in their cross-sectional planes;

wherein said matrix segments are arranged such that directions in which the Young's modulus of the matrix segments is low are substantially coincident with circumferential directions of said disk at least at four locations near an outer circumference of said disk, and directions in which the Young's modulus of the matrix segments is high are substantially perpendicular to said circumferential directions.

2. A rotary regenerative heat exchanging ceramic body according to claim 1, wherein said cells are rectangular in shape.

3. A rotary regenerative heat exchanging ceramic body according to claim 2, wherein a ratio of a short side to a long side of said rectangular cells is about $1:\sqrt{3}$.

4. A rotary regenerative heat exchanging ceramic body according to claim 1, wherein said cells are triangular in shape.

5. A rotary regenerative heat exchanging ceramic body according to claim 4, wherein said triangular shape is that of an isosceles triangle.

6. A rotary regenerative heat exchanging ceramic body according to claim 1, wherein each of said matrix segments forms a sector of said disk.

* * * * *